US011406229B2

(12) United States Patent
Dady

(10) Patent No.: US 11,406,229 B2
(45) Date of Patent: Aug. 9, 2022

(54) RETRACTABLE ROLL UP SHOWER CURTAIN KIT AND TUB FRAME SYSTEM

(71) Applicant: Timothy D. Dady, Pittsburgh, PA (US)

(72) Inventor: Timothy D. Dady, Pittsburgh, PA (US)

( * ) Notice: Subject to any disclaimer, the term of this patent is extended or adjusted under 35 U.S.C. 154(b) by 134 days.

(21) Appl. No.: 16/670,376

(22) Filed: Oct. 31, 2019

(65) Prior Publication Data

US 2020/0138245 A1 May 7, 2020

Related U.S. Application Data

(60) Provisional application No. 62/755,444, filed on Nov. 3, 2018.

(51) Int. Cl.
*A47K 3/38* (2006.01)
*A47H 1/142* (2006.01)

(52) U.S. Cl.
CPC ..... *A47K 3/38* (2013.01); *A47H 1/142* (2013.01)

(58) Field of Classification Search
CPC ... A47K 3/38; A47H 1/02; A47H 1/10; A47H 1/102; A47H 1/104; A47H 1/12; A47H 1/122; A47H 1/124; A47H 1/14; A47H 1/142; A47H 1/18
USPC ..... 4/557, 607, 608, 609, 610
See application file for complete search history.

(56) References Cited

U.S. PATENT DOCUMENTS

| | | | | |
|---|---|---|---|---|
| 5,732,419 | A * | 3/1998 | Feist | A47K 3/38 4/557 |
| 5,794,281 | A * | 8/1998 | Shearon | A47K 3/38 160/29 |
| 6,213,437 | B1 * | 4/2001 | Robbins | A47H 1/142 160/330 |
| 7,168,131 | B2 * | 1/2007 | Ruggiero | A47K 3/38 16/87.2 |
| 8,157,231 | B2 * | 4/2012 | Shiu | G02B 27/283 248/251 |
| 9,554,674 | B2 * | 1/2017 | Forrest | A47H 1/022 |
| 10,307,007 | B2 * | 6/2019 | Thomas | A47K 3/38 |
| 10,314,442 | B2 * | 6/2019 | Fields | A47H 1/102 |
| 2006/0021722 | A1 * | 2/2006 | Nien | A47H 1/142 160/330 |
| 2012/0017366 | A1 * | 1/2012 | Barrese | A47K 3/38 4/558 |
| 2012/0261371 | A1 * | 10/2012 | Baines | A47H 1/142 211/123 |
| 2018/0199747 | A1 * | 7/2018 | Moss | A47H 1/102 |
| 2021/0177185 | A1 * | 6/2021 | DiTrolio | F16B 2/10 |

* cited by examiner

*Primary Examiner* — William V Gilbert
(74) *Attorney, Agent, or Firm* — Gary P. Topolosky

(57) ABSTRACT

The present invention is a retractable roll up style shower curtain system that can replace traditional shower curtains eliminating any need for hooks, rings, or liners. The core components of the invention are a retractable roll up style curtain, two or more mounting brackets, and other, optional tub frame mounting hardware component parts. When properly installed, the user can simply step into his/her shower, pull the shower curtain down to the top of the tub where it will lock in place. When finished, pulling on the curtain once more will unlock the retraction mechanics and raise it up to the desired height for safely stepping out of the shower proper.

14 Claims, 12 Drawing Sheets

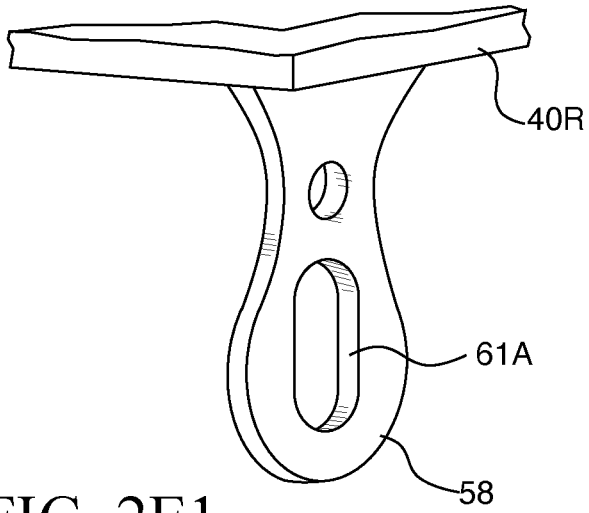
FIG. 2E1
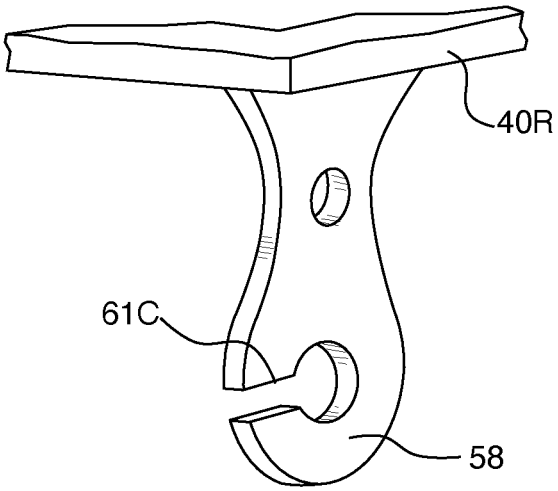
FIG. 2E2

RETRACTABLE ROLL UP SHOWER CURTAIN KIT AND TUB FRAME SYSTEM

CROSS REFERENCE TO RELATED APPLICATIONS

This application is a perfection of U.S. Provisional Application Ser. No. 62/755,444, filed on Nov. 3, 2018, the disclosure of which is fully incorporated herein.

BACKGROUND OF THE INVENTION

1. Field of the Invention

The present invention relates to shower curtains. More particularly, it relates to retractable shower curtains on a shower curtain rod. It further relates to using such shower curtains and shower curtain rods with an improved bathtub frame system per this invention to create a complete framed, shower curtain enclosure. The shower curtain and surrounding tub frame are do-it-yourself projects that easily install with little to no tooling other than standard scissors. The curtain components for these kits will be pre-sized to fit most popular bathtub widths (i.e., 4 or 5 feet wide) or made in still other kits for custom cutting to the desired end width. The shower curtains themselves, and in some cases the matching tub frame surrounds, will be made and sold in a variety of colors, prints, patterns and materials (e.g., like the one way, mirror window tinted fabrics that let one see out but not see in).

2. Relevant Art

Currently there are a number of solutions for shower/tub stall enclosures. Some of these solutions attempt to provide privacy and keep water from escaping in all the old traditional ways. But these solutions fail to meet the needs of the industry. And they have rarely been innovated.

Most recently, we have seen patented improvements like the retractable shower screen of Feist U.S. Pat. No. 5,732,419 and the shower curtain apparatus and method of Shearon U.S. Pat. No. 5,794,281. Lastly, there is the most recently patented retractable shower assembly of Fields et al. U.S. Pat. No. 10,314,442. Though two of the aforementioned are retractable like the present invention, it is submitted that Applicant's improvements patentably distinguish over the aforementioned prior art teachings and suggestions since:

- The present design is ready to mount to most standard shower stalls with no tools needed using the existing shower curtain rod.
- This invention does NOT require any housing around the curtain roll/roller.
- The frame pieces of this invention are independent of the curtain and not required for the shower curtain to function properly.
- The design of this invention need not be a permanent fixture; it can be assembled, unassembled and reassembled quickly with no tools, using no permanent mounts.
- The surrounding frame of this invention will still help keep water in the shower but is mostly aesthetic to complete the look. And it is made of cut-to-fit materials using only standard/average scissors.
- It has the only complete (top, bottom, left and right) independent tub frame surround.
- This invention includes a quick release curtain.

- Lastly, the main curtain component of this design can be easily released, changed out (for hygiene and/or aesthetic reasons) and a replacement curtain quickly reconnected into place without disturbing the frame.

Today's standard shower curtain and liner suspends from a rod generally using hooks or rings. It has probably been the prominent solution since the invention of the shower itself. Even now, over a hundred years later little has truly changed. Yet, it is still the "go to" primary shower/tub stall enclosure. It is time to let such enclosures of the past retire. Though they serve the need in the most basic way, we have long overlooked their many flaws.

When hooks are used to suspend the curtain, they rarely cooperate. They often fall off the rod, get tangled up with each other, or simply do not seem to slide along the rod very well. Then there is the hassle of changing the curtain and liner. First, one must undo all the hooks for changing out the soiled liner. Next, one must realign all the holes, reinsert all the hooks and hang it back on the rod. After all that, one will just to repeat the whole process, all over again—in a few months.

While the rings stay on and slide along the rod better, they are much tedious when it comes time to change out the curtain and liner. The curtain itself is not that bad; it is decorative and provides privacy. But depending on the overall bathroom layout, the shower curtain might also rub against a toilet, sink, trashcan or other undesired fixture. This may require it to be washed more frequently or changed altogether and we already discussed the hassle of taking on that project.

The liner is the most inconvenient part of an outdated shower curtain enclosure system. First, the liner hangs deep into the tub encroaching on available shower space while collecting excess soap scum and dirt. When the shower water is turned on, it creates a slight vacuum bringing the liner even closer to the body of the individual using the shower.

A curved curtain rod is available to help prevent the aforementioned negative situations. While curved rods create more room, one cannot change the curve of the tub below the rod so they have a minimal effect. What is the best thing to do with a liner when using the tub for bathing rather than showering? Does the bather leave the liner to soak in the tub with him or her? Or does the bather drape the liner outside to rub against the lower tub exterior? It seems to be a no-win situation; both choices are inconvenient.

Other solutions attempt to provide privacy to the party taking a shower while keeping most or all of the water IN the tub. But even these solutions are unable to meet the needs of the industry since these alternate enclosures come at a higher price point. Sliding shower doors, for example correct a few of the inconveniences of shower curtain liners, but they still have their own flaws. Installing shower doors require some construction skills and knowledge. Unless enlisting the help of a friend with the necessary skills and tools to properly install a set of sliding shower doors, one will probably need to hire a professional to get it done right. That may require more time and money than one is otherwise willing to spend. The permanency of a shower door install also takes it out of the realm for property renters, rather than owners.

If sliding shower doors are not properly maintained, they can lead to still other complications. The door tracks can get clogged or bent thus hindering how a shower door slides open or closed. Cleaning is a bit more involved as these doors only typically slide so far to one side or the other. Hence, most sliding doors can only be properly cleaned while standing inside the shower stall and closing the doors behind the party cleaning them. And when washing a child or pet, a showered door arrangement is more complicated since the one, main door only slides open so far.

Still other solutions seek to provide shower privacy and contain the water inside the tub. But these solutions also fail to meet many industry needs. Alternate remodeling enclosures only get more expensive and require more complicated construction. This demonstrates the definite need for a shower/tub stall enclosure that is fast, easy to install and affordably priced. The present invention can be installed in little time, using little to no tools and provide a watertight showering enclosure. With preset sizes, in different shades and patterns, this invention can also help change the LOOK of one's tub area with little time and effort.

SUMMARY OF THE INVENTION

It would be most desirable to have a new style of shower curtain system that can be mounted to an existing curtain rod and assemble in a few minutes and with few if any tools. It would be further desirable to have a one-piece curtain/liner that can be changed in and out in a matter of seconds thus eliminating all need for today's cumbersome hooks/rings and inner liner systems. Still further, it would be desirable to have a shower curtain that will stay flat and flush for creating more room both in and outside the shower/tub stall area.

There currently exists an industry need for a new shower curtain system design that takes very little time to install, with little to no tools, and can be subsequently taken out/down for changing-replacement in a matter of seconds thereby eliminating the hassle of hooks, rings and multiple (especially inner) liners. All of the foregoing is accomplished with the present invention while still further creating more room both in, and outside the shower stall proper.

Disclosed is a retractable roll up shower curtain made up of the following main components: (1) a pair of spaced apart curtain rod brackets (adapted for connecting to one's existing shower curtain rod assembly); and (2) the retractable roll up shower curtain, is spring loaded (much like a window blind) and adapted for pulling down and unrolling to the desired length before being locked in place at one or preferably both lower corners. Such a pull down curtain will provide privacy and keep water IN the tub (or shower stall) while in use. Upon completion of the shower, this improved curtain configuration is unlocked from its bottom hold(s), and tugged down (or pulled on once more) to engage the shower's retraction mechanics and raise the main shower curtain body back up to its desired resting height. Using optional mounting hardware, like a central rod support, additional parts can be mounted/attached for better securing the pull down assembly to an existing shower curtain rod configuration.

Other components to the tub system of this invention may contain one or more of:

FRAME—This shower curtain system is best complimented with an easy-to-install frame surround. That total frame system surrounds the pull down curtain on all sides (top, bottom, left and right). The frame is currently made from material that closely resembles (in size, shape, and material) the average vinyl/plastic vertical blind slat though it can also be made from many other materials, i.e., wood, metal, polymers, other composites, and in many different styles, patterns, colors, logos, etc.

The various horizontal and vertical components to this improved frame surround can be cut to fit the sizing needs and installed with minimal or no special required tools. The top frame piece to this shower frame surround is mounted to the curtain brackets (or by other means) for running along the top of the curtain parallel to the curtain rod. The top frame piece will help to hide curtain mechanics and mounting hardware thus creating an aesthetic frame to the top of this curtain arrangement.

The bottom frame piece is L-shaped, lengthwise so that a typically sized bottom frame piece might measure 4" wide by 5' long as a slat having a 2" front and 2" bottom component, the latter for mounting to (or over) a top lip of the bathtub. Note, this same bottom frame piece will help keep any water from pouring off the curtain and out of the tub. Instead, the bottom frame piece will manage to cause curtain water runoffs to run back into the tub bottom. Optionally, this bottom frame piece may be made to either fold flat, or made from a softer rubber or foam-like material that would less intrusive to an adult or grown leaning over such an installed bottom piece to bathe a young child or pet.

The left and right side frame pieces would both be cut the first time for fitting in/onto the top and bottom frame pieces or other system mounts. These side frame pieces are meant to keep any water from splashing out the sides of the shower stall while also aesthetically completing the frame around/about the whole shower opening.

In one embodiment, both outside corners of the bottom piece are fitted with an add-on ledge/clip to help ensure the shower curtain remains locked down and in place while in use. In an alternate version, preferably both lowermost ends to the interior of the left and right side frame pieces may be fitted with (or have adhesively applied thereto) a similar bottom shower curtain edge lockdown ledge and/or clip.

WATER DISPLACEMENT DEVICE—This shower curtain system could have a squeegee-like device that would be mounted in such a manner that would help displace excess water from the curtain as the curtain is retracted. One or more squeegee supports may be added to the inside of any supplemental top bar brackets intermediate the curtain rod, top bar brackets at both the left end, middle and right ends of the existing shower curtain rod.

SPECIALTY RESISTANCE MATERIALS—This shower curtain system could have parts made of or treated with resistance properties such as but not limited to: anti-fungal, anti-mold, anti-microbial, hydrophobic, anti-creasing, etc.

CURTAIN STABILIZING DEVICES—This shower curtain system could have devices that would help keep the curtain flush to the frame or from premature retraction or over retraction. These could be devices including but not limited to magnets, locks, various adhesives, braces, etc. They could also be made from various materials such as but not limited to plastics, rubbers, metals, etc. One means for stabilizing the invention is to provide one or more intermediate top bar clips for installing over the existing shower curtain rod. On the fronts of these additional clips, they may be provided with double backed tape for helping to better secure the top tub frame support in place. In addition, the curtain itself may have a stabilizer bar/stiffener inserted into its bottom edge. More preferably, that stiffener can be weighted for extra stabilization.

CURTAIN HANDLES/GRIPS—This shower curtain system could have permanent or removable handles/grips attached to the curtain for ease of use. They could be attached by and/or made of materials such as but not limited to wood, plastic, rubber, metal, magnets, adhesives, etc.

CURTAIN ROD SUPPORTS/BRACES—This shower curtain system could have curtain rod supports/braces that would help ensure the stability of the curtain or curtain rod. This could be achieved in many different ways with various materials or a combination of materials such as but not limited to wood, plastic, rubber, metal, permanent/temporary adhesives, etc. They could be applied to the shower/tub's sidewalls by first taking down the curtain rod, adding the supplemental support braces and then re-installing the rod back in place.

The disclosed device is unique when compared with other known devices and solutions because it provides: a shower enclosure system that assembles in minutes with no tools, a one piece curtain/liner that can be changed in seconds and eliminates the need for any hooks, rings, or liners. The shower curtain operates like a retractable roll down window blind providing privacy and keeping the water in the shower stall. This combined with the frame provides a flat, flush, low profile finish. This curtain system stays flat and only unrolls from the curtain rod to the top of the tub eliminating any inner or outer curtain overhang. With the curtain remaining flat and not draping into the tub this creates more room in the shower and less area for the curtain to collect soap scum and dirt build up. When the curtain is retracted and left up it provides plenty of room for entering and exiting the shower or for cleaning the shower stall. The one piece curtain/liner can be easily removed or replaced without disturbing the frame, yet if needed the frame can also be easily removed and reassembled unlike a shower door system. The roll up shower curtain system is simply a better shower enclosure option for so many reasons and has so many superior benefits that make traditional shower curtains and doors obsolete.

The disclosed device is unique in that it is structurally different from other known devices or solutions. More specifically, the device is unique due to the presence of: a flat, retractable roll up style shower curtain and easy to assemble cut to fit frame. The one-piece shower curtain/liner is mounted to the curtain rod by two brackets. This allows for a fast and easy curtain change without the need of any hooks, rings, or separate inner liners. The frame is a very simple cut to fit design that can be assembled in minutes. An average pair of scissors is all that is needed to cut the frame material to the needed size. Furthermore, the frame is assembled with simple adhesives and fasteners such as but not limited to double sided tapes and sticky backed hook-and-loop (or Velcro®) style fasteners. The simplicity of this design makes it easy for anyone to assemble. The fully assembled product appears as a flat rectangle when the curtain is pulled down. And it runs from the curtain rod down to the top lip of the tub with the frame bordering it on all sides. If one loves the look of a traditional shower curtain, he/she can simply mount one right in front of the roll up shower curtain system and still enjoying all the other benefits of the roll up shower curtain system.

This disclosure will now provide a more detailed and specific description that will refer to the accompanying drawings. The drawings and specific descriptions of the drawings, as well as any specific or alternative embodiments discussed, are to be read in conjunction with the entirety of this disclosure. The retractable roll up shower curtain may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

Further features, objectives and advantages of the present invention will be clearer from the following detailed description made with reference to the accompanying drawings in which:

FIGS. 2E1 and 2E2 show alternate clips for the opposite (or right side as depicted herein) for holding the spring loaded main shower curtain body. FIG. 2E1 shows an elongated, rectangular aperture into which the curtain's right side body pin would be fitted into place; FIG. 2E2 shows another alternate clip variation with a cut out recess formed into the body proper of that lower, right side clip alternative.

DETAILED DESCRIPTION OF PREFERRED EMBODIMENTS

Figure 1A:
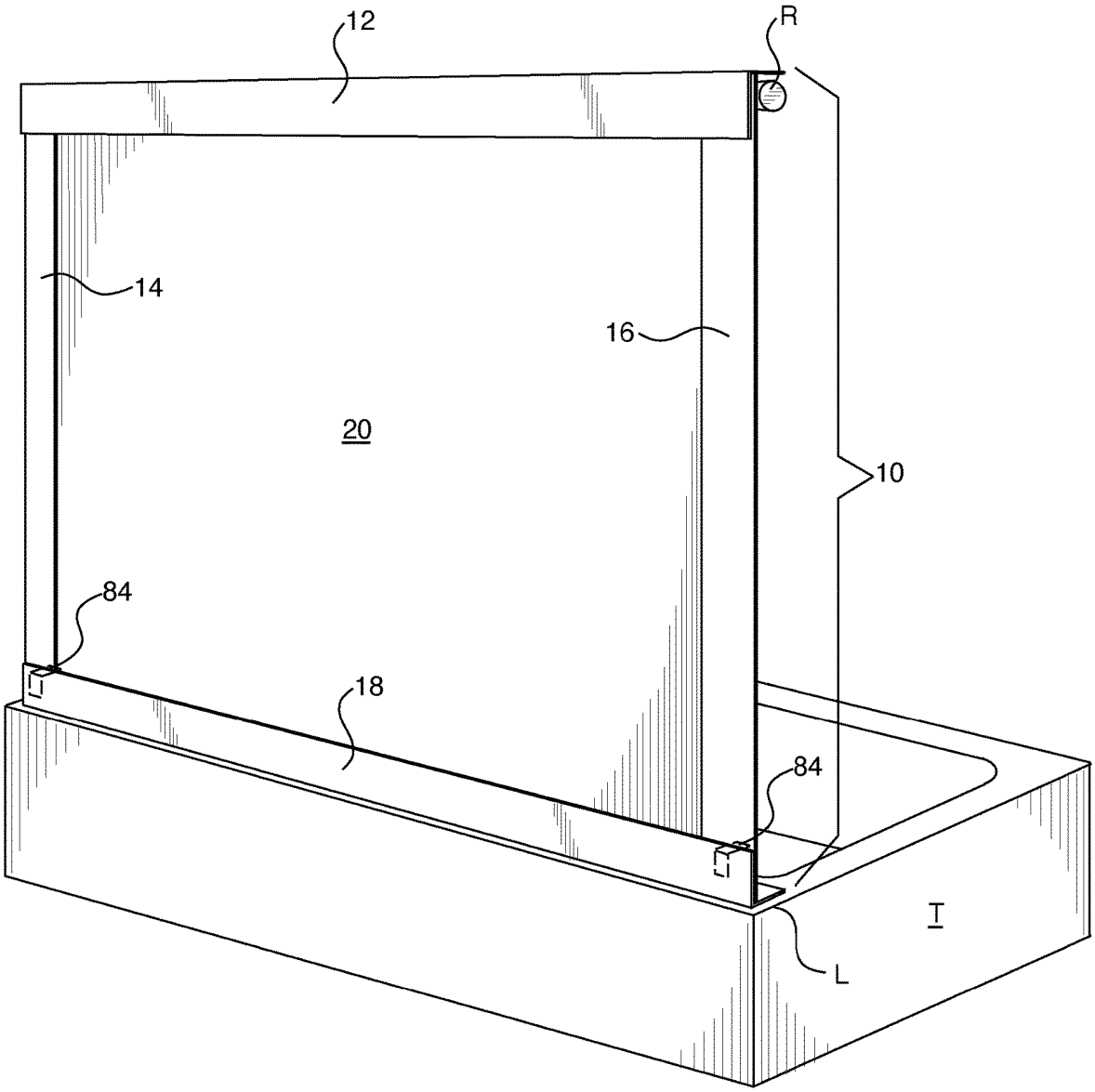
FIG. 1A is a front perspective view of one embodiment of this invention, both shower curtain and frame surround, installed on a bathtub (with the right sidewall removed for better illustration). In this view, the shower curtain has been pulled down and locked in place.

The present invention is directed to retractable roll up shower curtain

In its most complete base model version, the device is made up of the following components:

1. A PAIR OF SHOWER CURTAIN BRACKETS—These brackets will attach the shower curtain to the curtain rod at opposed ends of one's existing shower curtain rod. They are intended to fit tightly enough as to limit any rotational movement of the brackets about the rod. The brackets also have a quick release that enables the shower curtain to be attached and detached quickly and easily.

2. SHOWER CURTAIN—This piece is a retractable roll up curtain like that of a roll up retractable window blind. The curtain is pulled down while unrolling to the desired length and the retraction mechanics lock in place. Pull the curtain again to engage the retraction mechanics and raise curtain back up to the desired height. The curtains main purpose is providing privacy and keeping water in the shower stall. As bathroom decor styles vary, the curtain is available in various colors, patterns, designs, and materials. It can be supplied in a preset width matching those of most standard U.S. tubs, either 4 or 5 feet wide. Or an alternate version may enable cutting-to-width variations, just like that for some window blind rollers.

3. FRAME—The frame surrounds the shower curtain on all sides (top, bottom, left, and, right) keeping in excess water, covering the curtain brackets and mechanics, while providing a neat clean frame around the shower curtain. The frame pieces are similar in size, shape, & material to that of (plastic/vinyl) vertical blind slats. The frame pieces may be cut with average scissors to fit the sizes needed. The bottom piece is "L" shaped (i.e. a 4" wide, by 5' long piece, would be 2" front, 2" bottom, by 5' long) and runs along the top of the tub to direct water into the tub. These frame pieces are also available in various colors, patterns, designs, and materials. At the lowermost edges of this frame surround, either at the opposite corners to the bottom frame piece, OR to both lower ends to the two sidewall pieces (both left and right side wall frame surround parts), there is provided a ledge and/or clip for holding in place, i.e., locking down, the extended, unrolled curtain rod while in use. Such curtain lock ledges/clips may be secured to their respective locations with adhesive tape, physical fasteners or both.

4. MOUNTS & MOUNTING HARDWARE—These devices are used for supporting, attaching, and/or fastening any and all parts. A grip handle is also included in these parts.

These components are assembled as follows:

1. The main shower curtain brackets are mounted to the curtain rod using the required mounts and mounting hardware. The brackets can slide along the curtain rod while locating the desired placement on the rod before being locked in place thereon.

2. The shower curtain attaches at each end to the brackets in a quick attach/detach manner.

3. The top frame piece is cut to fit and then attached to the curtain rod using the required mounts and mounting hardware.

4. The bottom frame piece is cut to fit and then attached to the top of the tub using the required mounts and mounting hardware.

5. The left and right frame pieces are cut to fit and attached at the top and bottom using the required mounts and mounting hardware.

6. The base model handle can be snapped on or slid on to the bottom of the curtain from the side if preferred, yet the roll up shower curtain system will function properly without the handle.

It should further be noted that this is a No-Tools-Needed design when using a main curtain body sized to fit a standard tub width, either 4 or 5 feet wide. Average/standard scissors may only be required for cutting the lengths of certain tub frame surround components. The mounts and mounting hardware pieces consist mostly of double-sided tapes, sticky back hook-and-loop fastener, and/or other such fasteners known in the industry. These devices can also be cut to size with scissors. A measuring tape may be used if exact measurements are preferred.

The retractable shower piece could allow for curtain only change outs . . . thus allowing for the retraction mechanics and housing to be used again. This could be achieved using hook-and-loop fasteners, reusable adhesives, zippers (plastic or metal) and/or by other known or subsequently developed methods of attachment and/or reattachment.

Figure 1B:
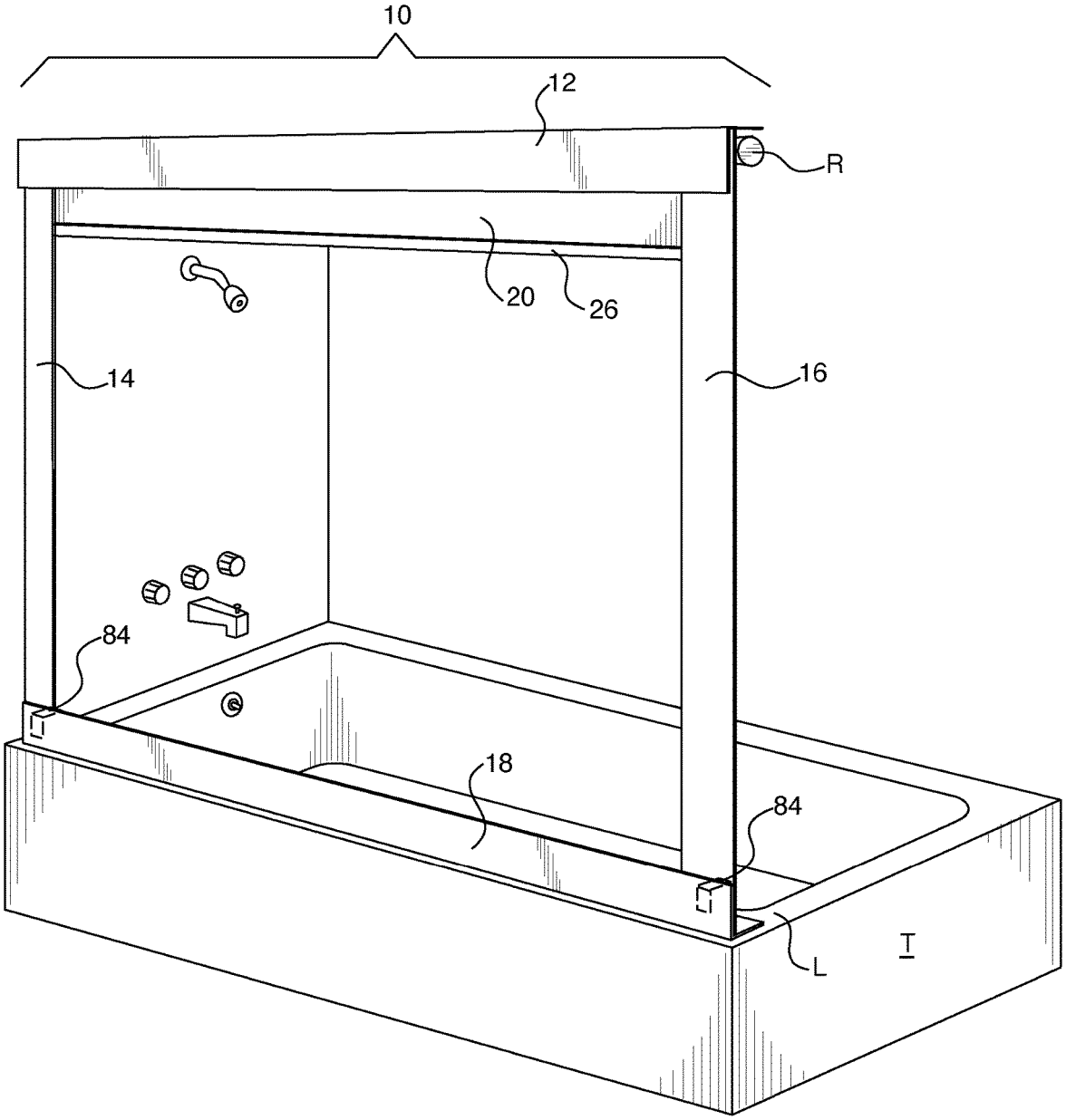
FIG. 1B is the same front perspective view as in FIG. 1A but with the shower curtain retracted almost al the way up.
Figure 2A:
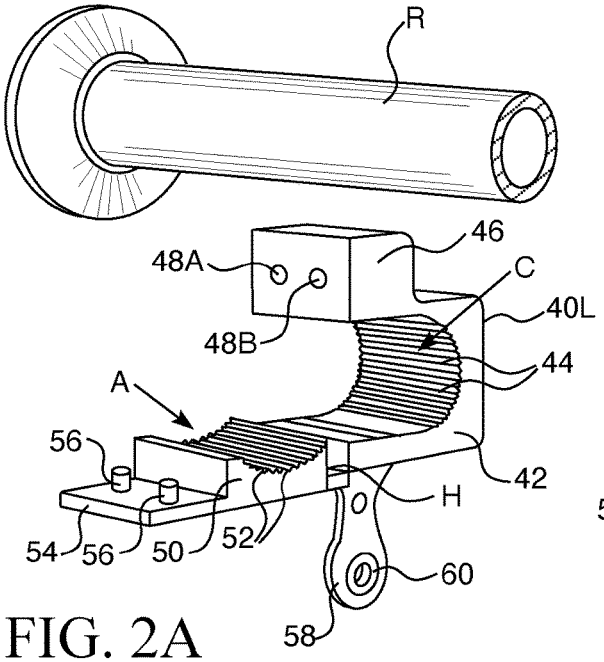
FIGS. 2A through D are front perspective views focusing on the rod mounting bracket of this invention: beneath an existing shower curtain rod (2A), partially installed over the curtain rod (2B); locked in place over the curtain rod (2C) and about to have a shower curtain inserted into the lower flange of said bracket (2D).
Figure 2B:
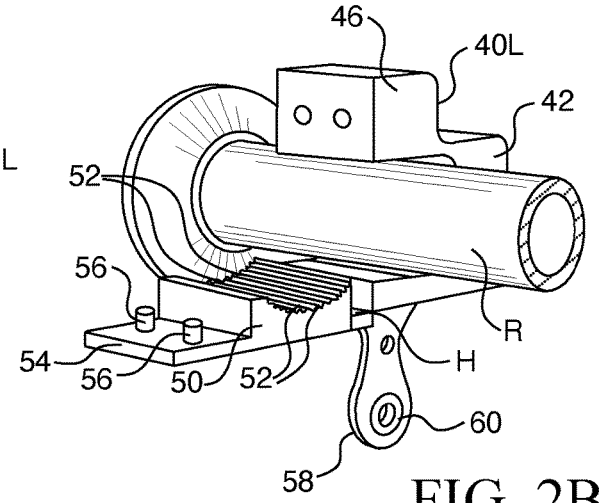
Figure 2C:
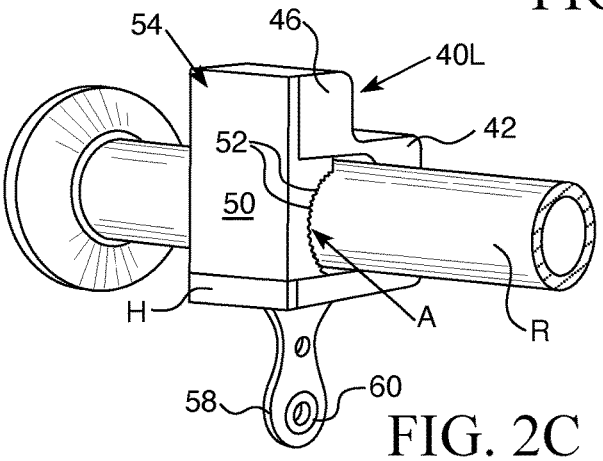
Figure 2D:
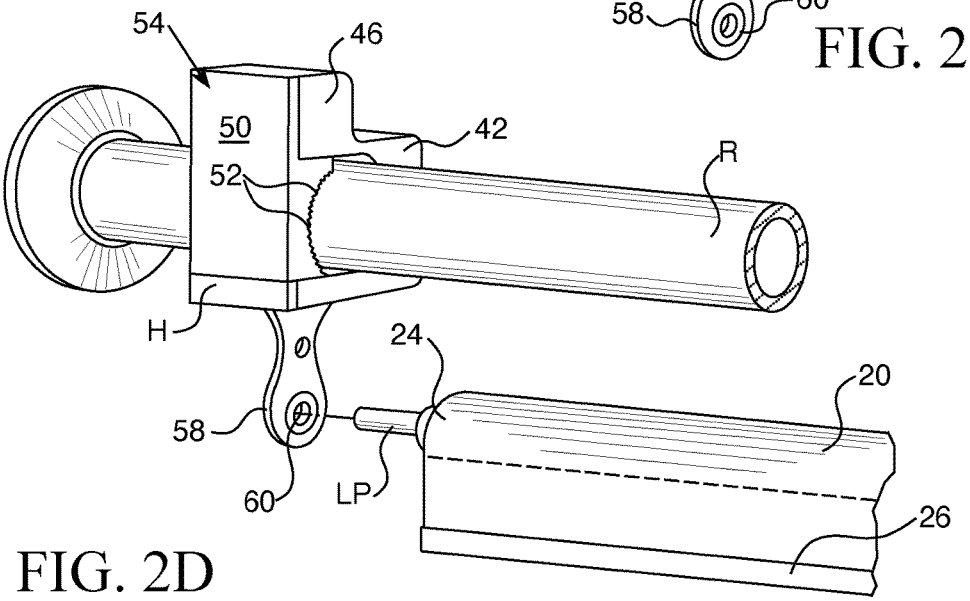
Figure 3A:
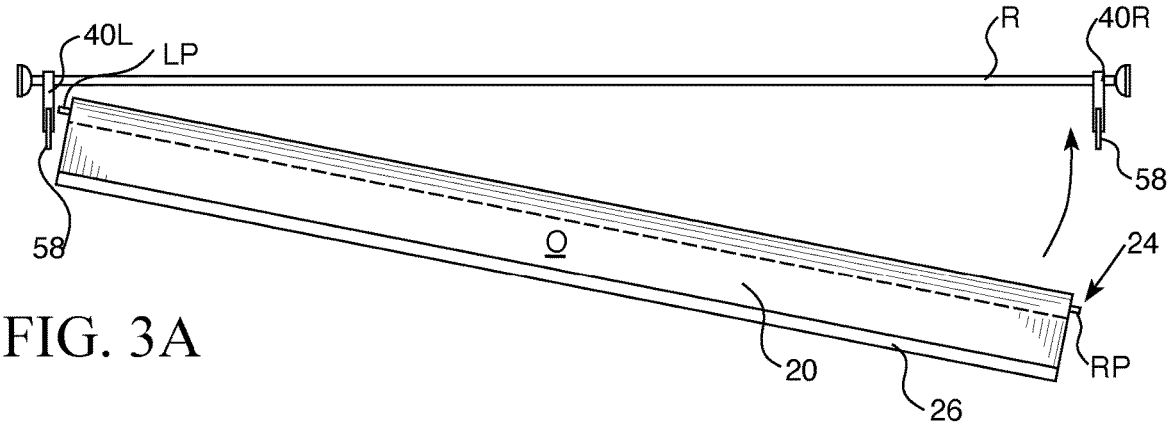
FIG. 3A is a front plan view showing a shower curtain being installed between the left and right brackets of one embodiment of this invention.
Figure 3B:
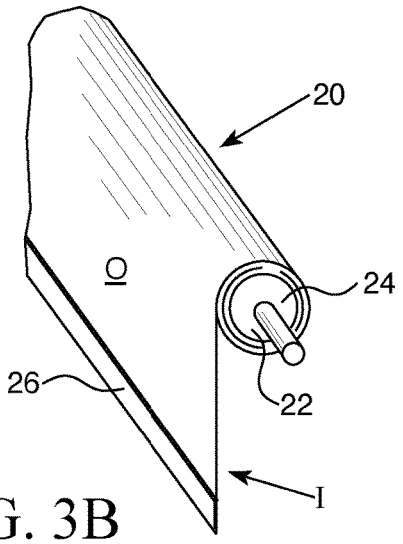
FIG. 3B is a perspective view showing the axial mounting of a shower curtain so as to unwind downwardly and outwardly.
Figure 3C:
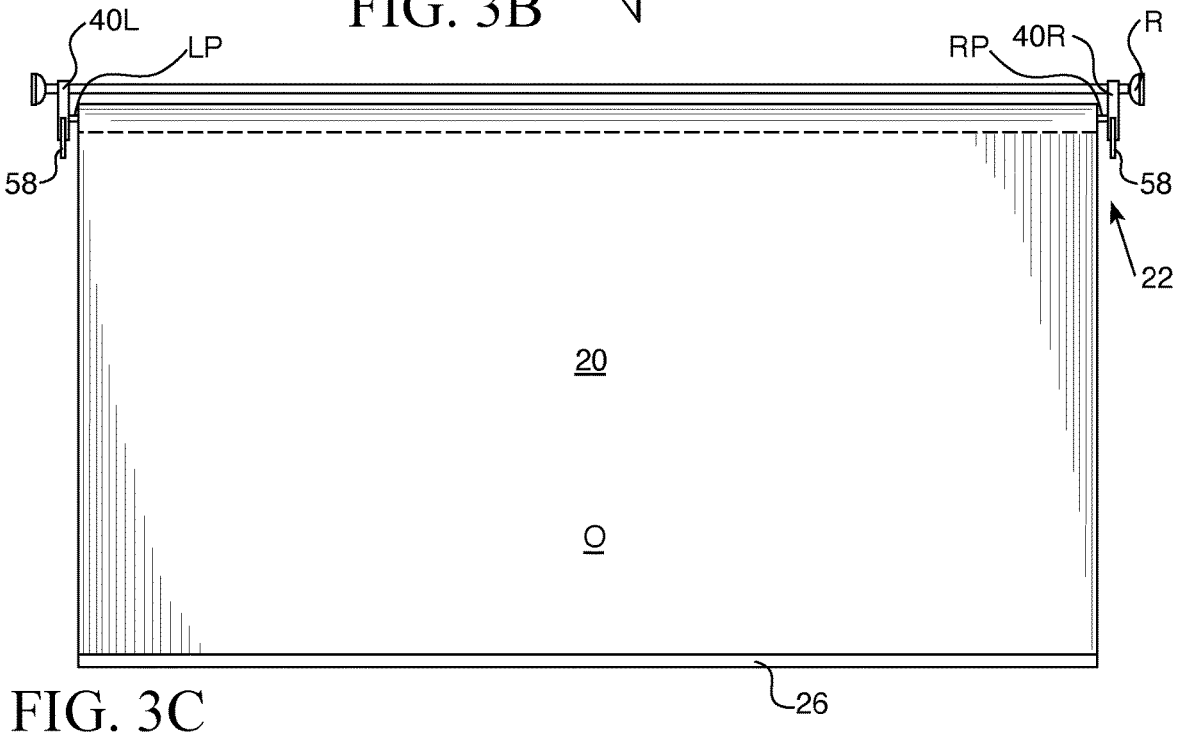
FIG. 3C is a front plan view showing the directional unwinding of a shower curtain of this invention indicated by the dashed lines at the top of the curtain.

Referring now to the accompanying drawings, there is shown a shower curtain system with complete tub surround frame, generally 10, on a typical bathtub T, with its pre-existing shower curtain rod R in both a closed-for-use (i.e., showering) mode (FIG. 1A) and raised (FIG. 1B) for leaving the tub after showering, tub cleaning and/or storage when not in use. Main sections of this tub surround frame include an upper tub frame panel 12, a downwardly extending left side frame panel 14, its right side, downwardly hanging/extending equivalent frame panel 16 and a lower curtain, horizontally extending bottom frame panel 18 for attaching to an upper ledge surface L of tub T.

Figure 5A:
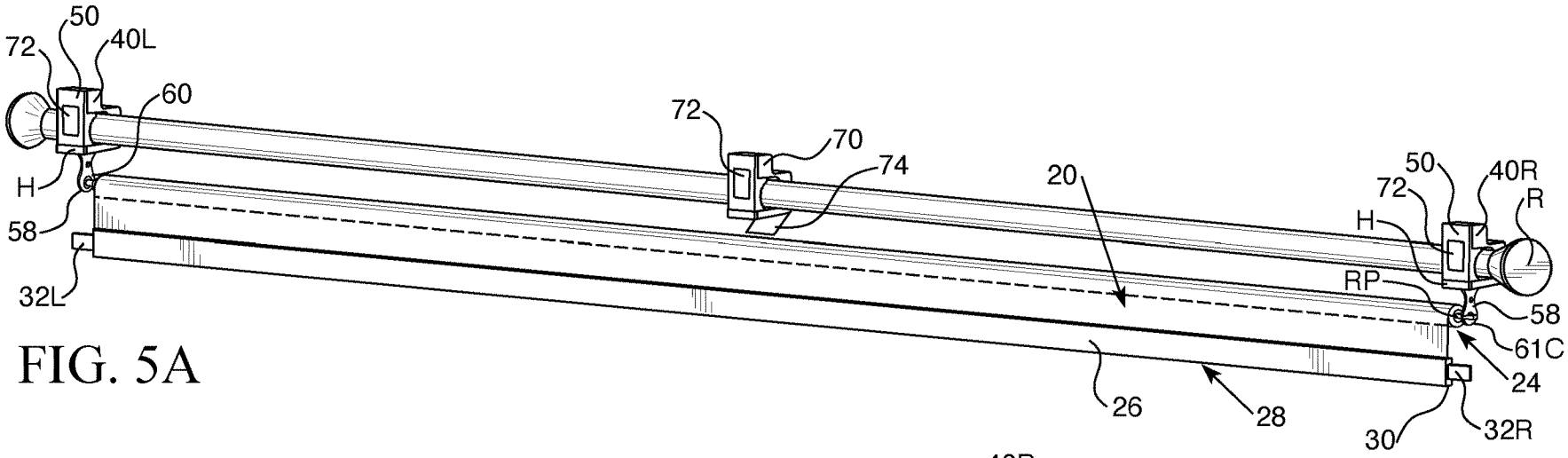
FIGS. 5A and B are perspective views showing the optional lower curtain insert side extensions in a full width (5A) and right side close up view (5B).
Figure 5B:
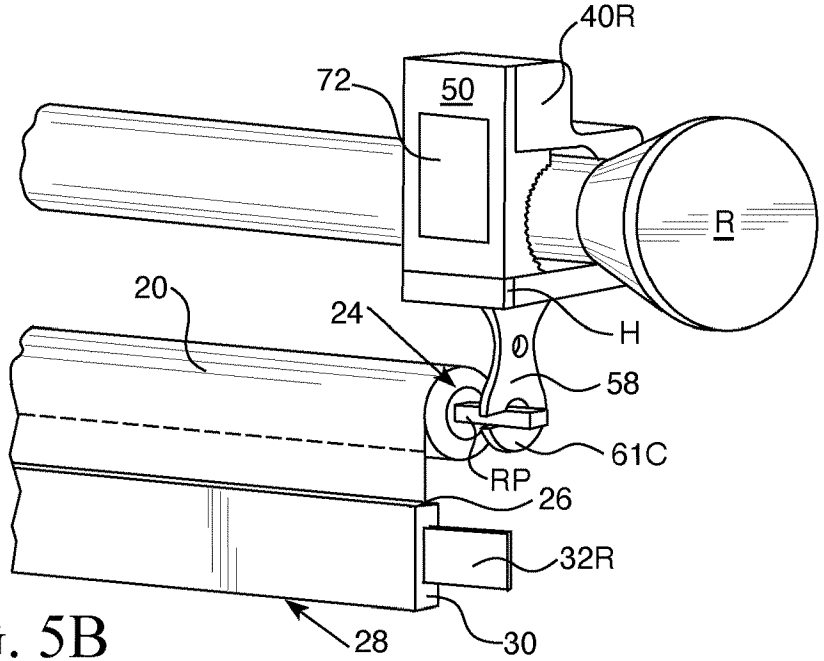

The main component of this invention is its retractable, roll up shower curtain body 20. It has an inside face I and an outside face O. This curtain body attaches at its top end 22 to a spring-loaded, retractable roller 24. Curtain body 20 also has a lower edge 26 with a lowermost track region 28 into which a curtain-stiffening insert 30 is preferably added. It is preferred that one or both ends of insert 30 include track extension pieces 32L and R per FIGS. 5A and B. They serve two purposes: first, they prevent the curtain body proper 20 from retracting too far/too fast upwardly back up to the bar roller after use. Secondly, and more importantly, they can be used as lower edge lockdowns (to the bathtub surround frame pieces, (or to an adhesively secured ledge/clip when no tub frame surround has been installed), so as to keep a pulled down curtain for unexpectedly retracting back up—in mid use/mid shower! Particularly, clips 84 are adhered to the lower innermost sides of the bottom frame panel 18, closest to the tub's sidewalls (as per FIGS. 1A and B) for interacting with extension pieces 32L, R. Alternately, clip ledge holders 86 (in FIG. 7A), may be secured with adhesive tape 88 to the lower insides of both left and right side frame panels, 14 and 16 respectively for the same lockdown purpose.

In some alternate variations (not shown), extension pieces 32L, R may be fitted in sidewall tracks added to the left and right side tub walls adjacent left and right side frame panels 14, 16, or to an alternate version of such frame panels having added guide tracks along their respective inner edges.

FIGS. 2A through D show the main curtain brackets 40 of this invention. Ideally, there is a left side bracket 40L and right side bracket 40R for attaching onto and locking about opposed ends of an existing shower curtain rod R. Each bracket 40 consists of a C-shaped main bracket body 42, having a plurality of toothed extensions 44 for better adhering about an existing curtain rod R and preventing undesired rotation about that rod once installed. These toothed extensions can be polymer-based, rubberized or most any other material for deterring rotation of an existing shower curtain within the bracket after it has been installed thereabout.

Each bracket 40L, R includes a top extending latch 46 having one or more apertures 48A, B for receiving matching extensions from the other main body portion, wrap around section 50 that together with main body bracket 42 encases existing curtain rod R. As shown, main bracket body 42 connects to (and can be integrally formed with) wrap around section 50 via hinged region H.

Wrap around section 50 has its own arched region A with a plurality of toothed extensions 52 for preventing the curtain rod encased inside bracket 40 from unduly rotating about inside each fully installed bracket 40L, R. For matching up with, and interlocking to, the plurality of apertures 48A, B in main bracket body 42, a leg extension 54 to wrap around section 50 includes one or more protrusions 56 (two are shown).

Finally, each bracket 40L, R includes a shower curtain downward protrusion 58. In one of the two main brackets, 40L as shown, there is included with protrusion 58 an aperture 60 for holding one end, i.e., the left side post LP, to the spring-loaded main shower curtain 20. In a first embodiment, protrusion 58 extends from a midway point on bracket 40L. Alternately, the protrusion 58 may extend downward from either a left or right bottom wall to left bracket 40L. Somewhat similarly, right bracket 40R has its own downward protrusion 58. But so as to better hold the elongated rectangular post RP on the right side of a wound up curtain 20, the right side's holder means can either be a rectangular share hole 61A in FIG. 2E1, or a fully cut out, rightly shaped recess 61C as per FIG. 2E2.

Figure 4A:
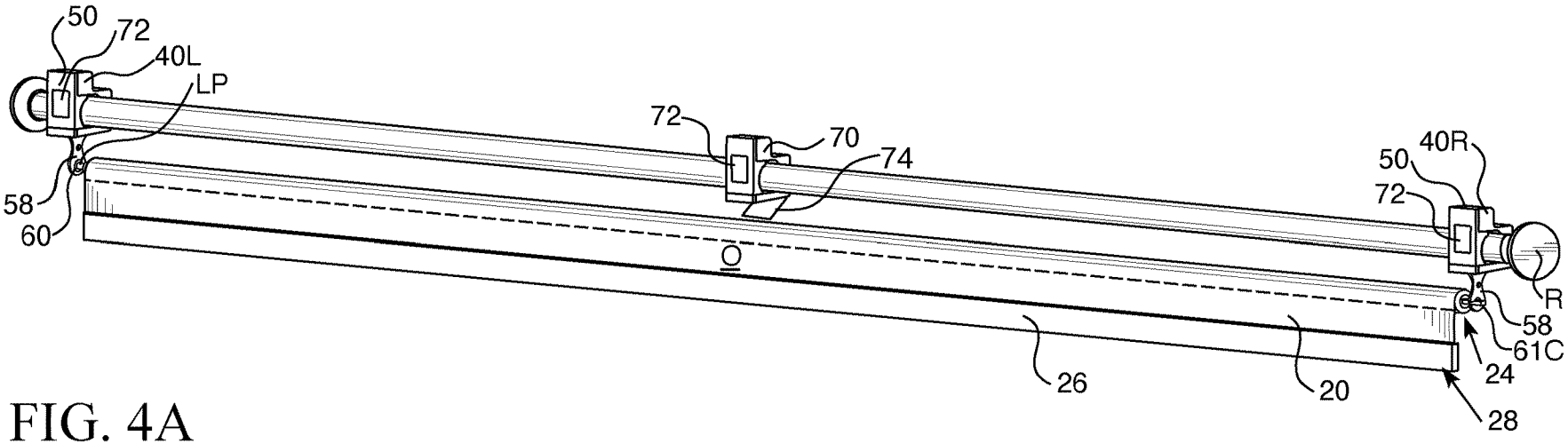
FIG. 4A is a perspective view showing an optional central mounting bracket for greater stabilization of the upper horizontal component in a tub frame support aspect of this invention.
Figure 4B:
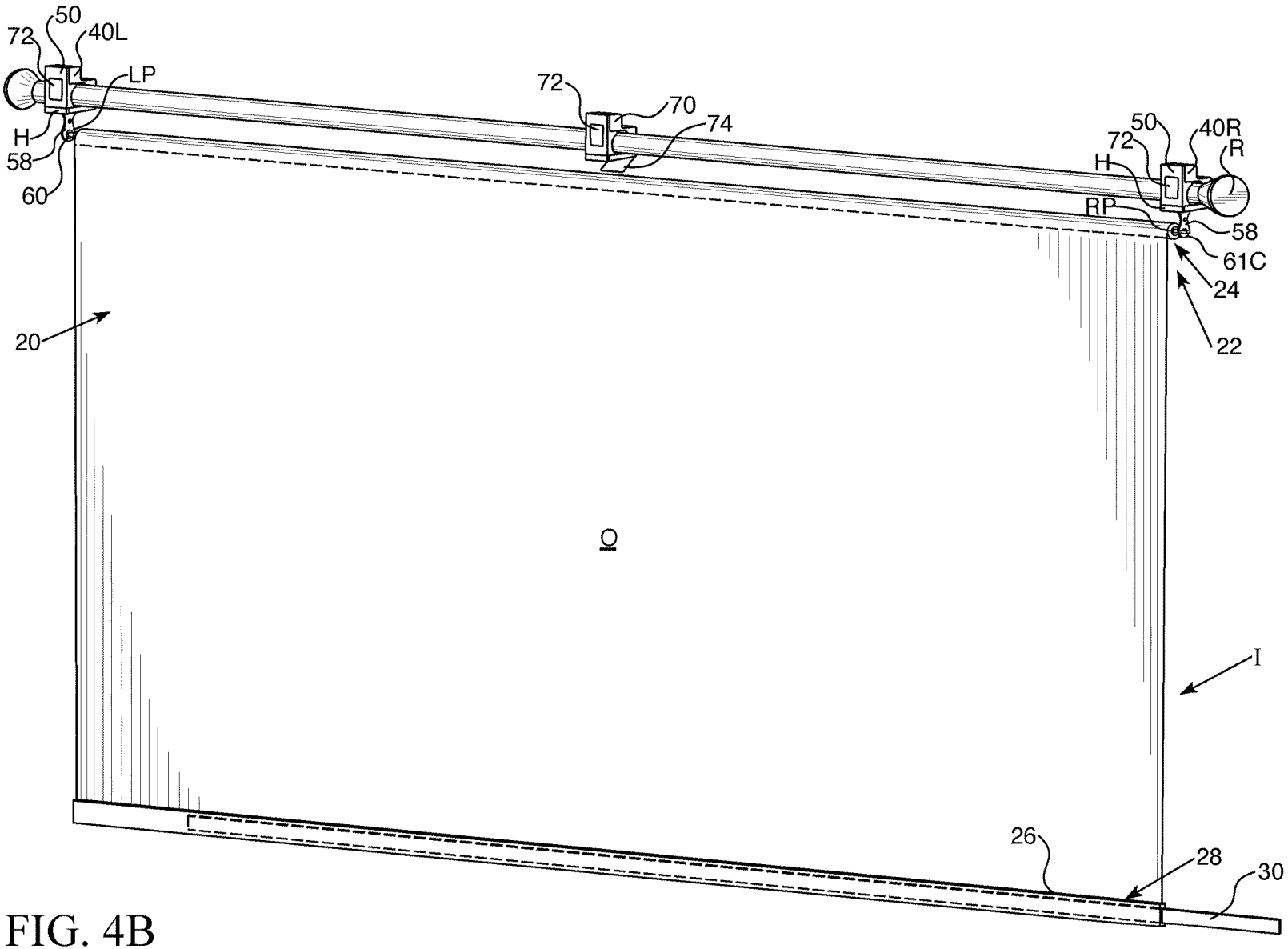
FIG. 4B is a perspective view showing the addition of the upper horizontal component on the existing curtain rod and an optional lower curtain stabilization insert into the base of the retractable shower curtain bottom.
Figure 4C:
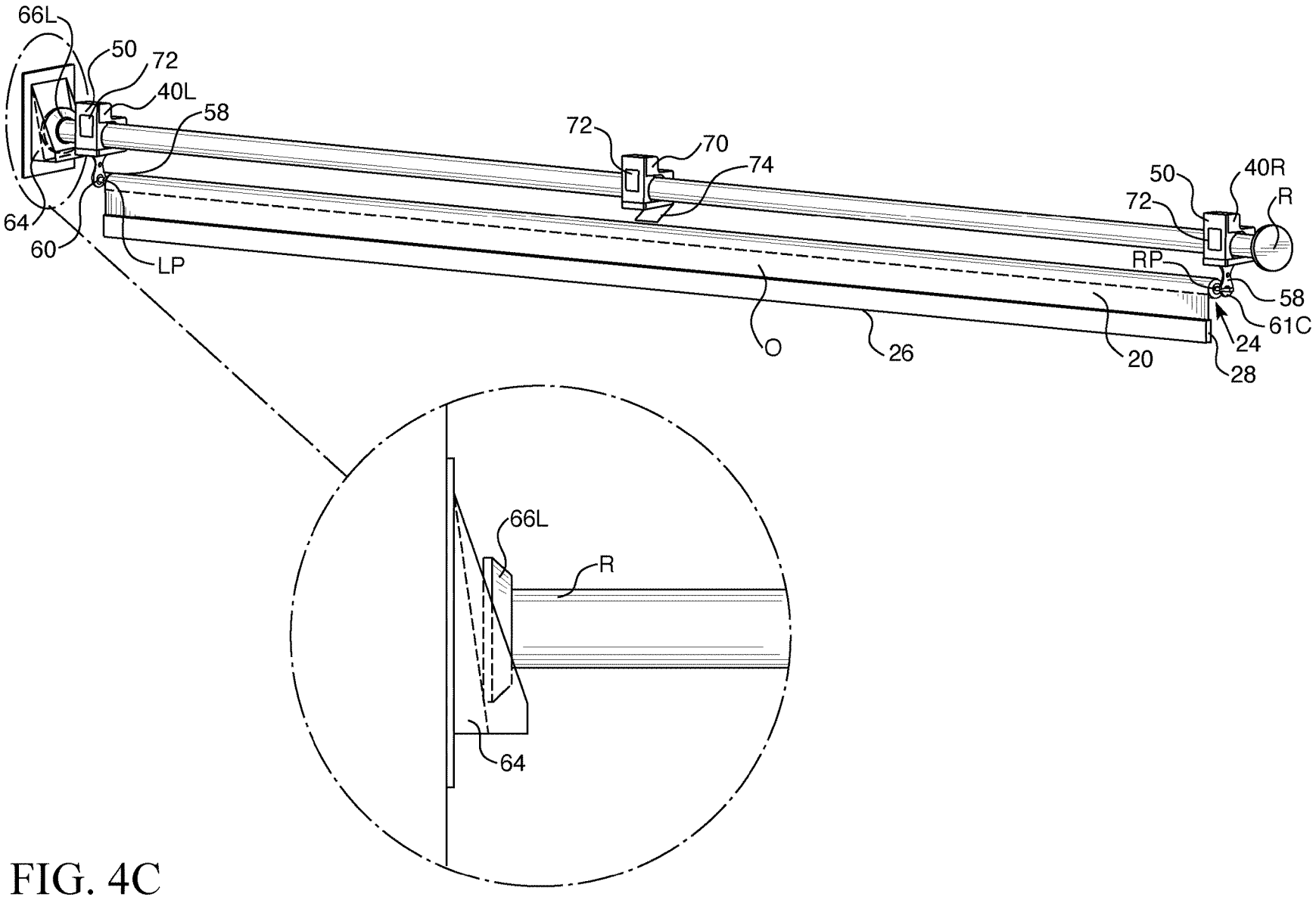
FIG. 4C is a perspective view, then exploded side view of an optional wall mount bracket for adding to the aforementioned showing curtain mounting assembly package.

In FIG. 4C, there is shown a first alternative of existing shower curtain support. Particularly, it is a cup-like adapter 64 into which each main end 66L, R of the existing shower curtain rod R will rest when held in place by gravity, a fastener, an adhesive or combinations thereof. Though FIG. 4C includes a left side perspective view of such a supplemental rod support, and a side view enlarged version in the circled area of the same FIG., it is to be understood that the same would apply to the opposite end of curtain rod R as well.

FIGS. 4A and B also exhibit a preferred intermediary upper frame support 70, installed midway along curtain rod R. It is to be understood that preferred embodiments of the tub frame surround of this invention may include one, two or even three such supports, duly spaced apart and having a section of self stick adhesive tape 72 applied to the front face of this extra curtain rod support R. Similar sections of tape 72 would be added to the top front faces of both left and right main support brackets 40L, R. In addition, note the inclusion of a rearward curved support bracket 74 from the bottom end of this central, intermediary support 70. The latter would provide support when an optional water diverter is added as best exhibited in accompanying FIG. 8.

Figure 6A:
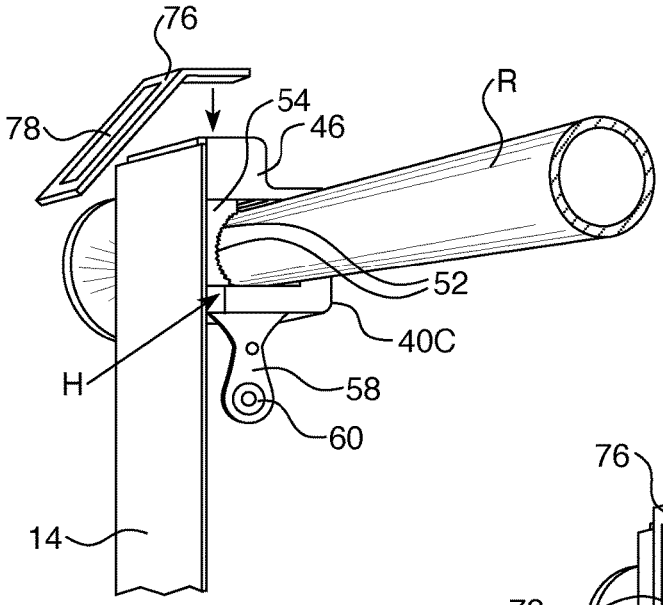
FIGS. 6A and B are perspective views showing the clamp down means for securing the tub frame side panel to a curtain-mounting bracket per one embodiment of this invention.
Figure 6B:
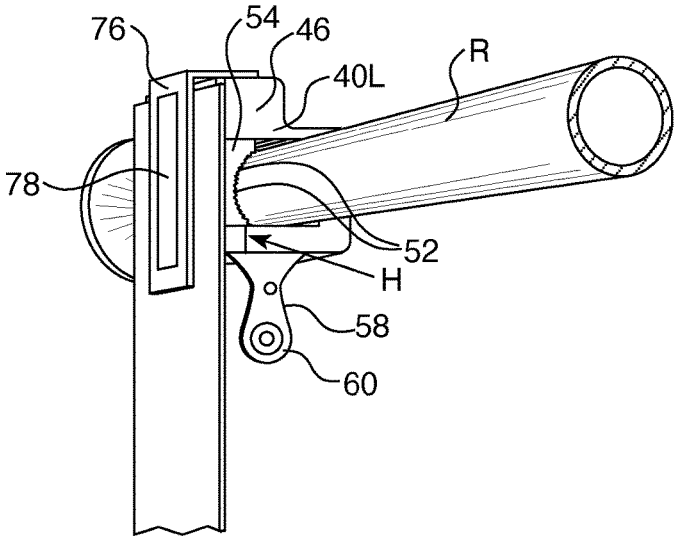
FIG. 6C is a front plan view of the mounting bracket and tub frame side panel from FIGS. 6A and B over which a tub frame top panel cover has been installed.
Figure 6C:
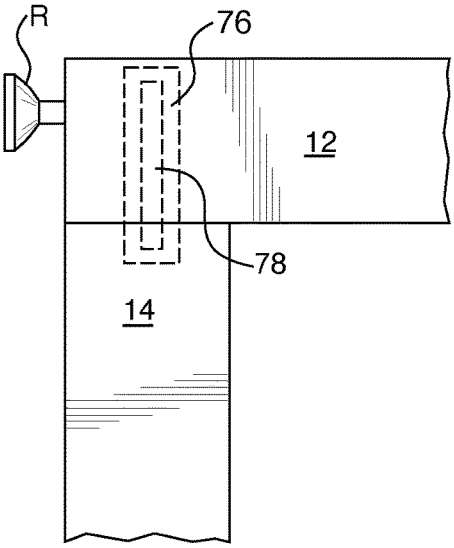

FIGS. 6A through C focus on one preferred embodiment of installing tub frame components to an existing shower curtain rod R onto the main bracket system of this invention has been installed. As seen in FIG. 6A, bracket 40L has been secured about the left most end of rod R. Thereafter, a sidewall support clip 76 has been fitted onto (from above) the top of bracket 40L with a section of adhesive tape, physical fastener or both. After it has been "installed" and flipped down, an outer strip of double-sided tape 78 may be peeled away in order for the left side frame panel 14 to be adhered thereto. With physical attachments (such as clamps or snaps), there would be greater repeatability of frame panel strip installations about the tub frame proper, extending downwardly from brackets 40L, R.

As seen in FIG. 6C, the entire upper componentry of the frame surround 10 to this invention is on greater display with: a side wall panel extending vertically down along a side edge of the shower curtain AND a horizontally extending top or upper wall panel 12 running from left-to-right, as shown. The latter panel may either abut the left side frame panel 14, or fully/partially overlap with the same.

Figure 7A:
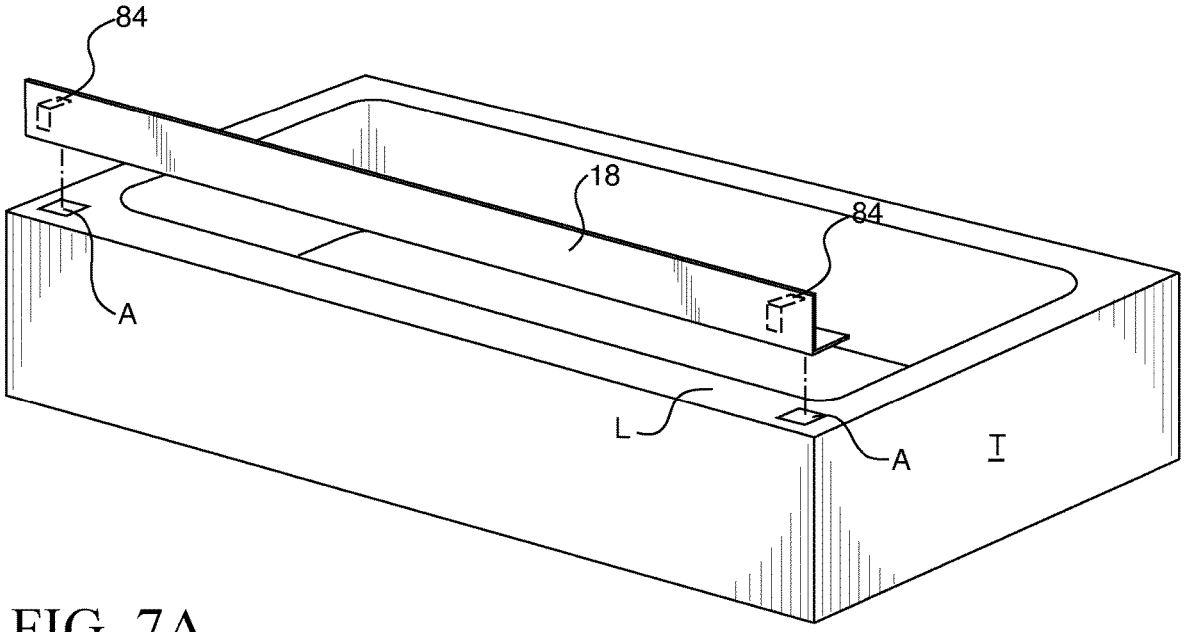
FIGS. 7A and B are perspective views showing a tub frame bottom panel adhered with waterproof tape to top front corner ledges of the tub (7A) before the lower ends to both frame side panels are secured thereto (7B). These same figures also show lower end lockdown alternatives; either to the bottom frame piece side corners (7A) or to the lowermost edges to both left and right side fame panel pieces (7B).

FIGS. 7A and B show the last physical components to the full tub surround 10 of this invention. Firstly, an L-shaped bottom frame support 18 is secured (with waterproof adhesive squares A) to an uppermost planar ledge L along the front edge to tub T. Then, using either additional strips of adhesive tape 80L, 80R, (or physical fasteners/anchors, or both), the lowermost edges 82L, 82R of both side frame panels 14, 16 are adhered to the INTERIOR of bottom frame support 18 (after cutting to length—with scissors) for forming a full tub surround framing to the retractable curtain 20, suspended from an existing curtain rod R.

Figure 7B:
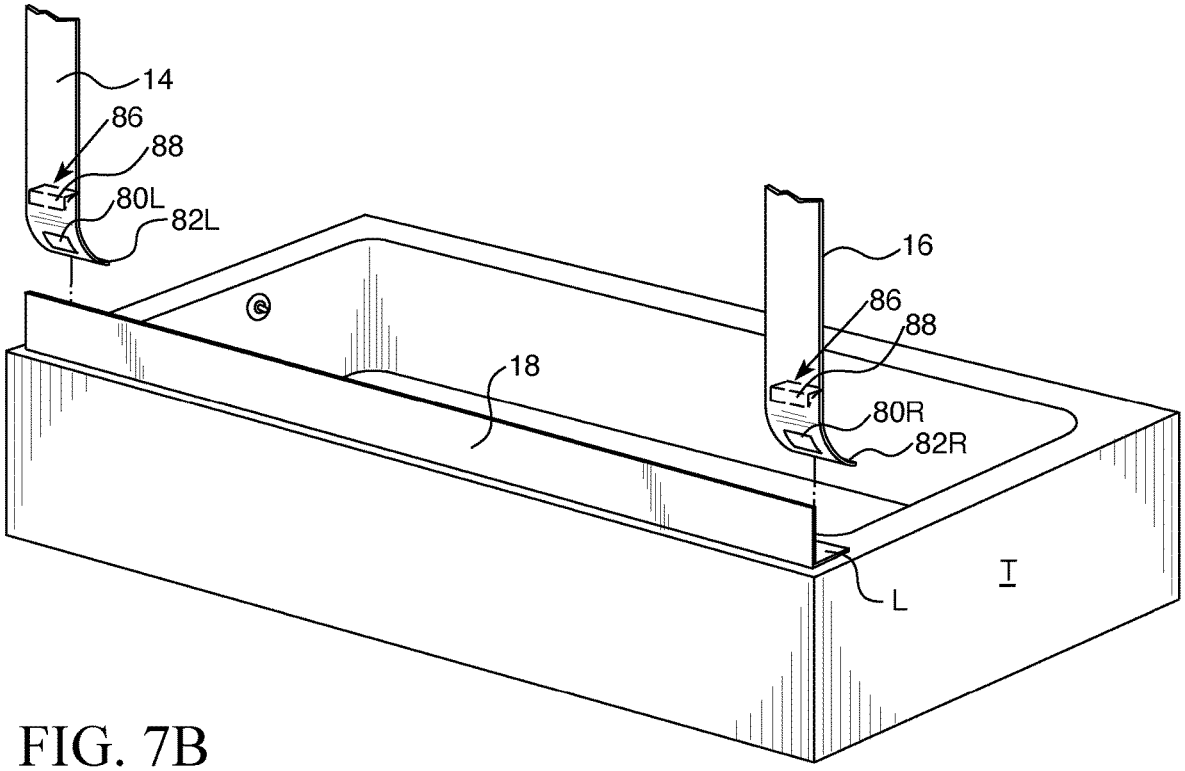

FIGS. 7A and B also show the two main preferred locking means for use with the preferred curtain rod extension pieces 32L, R. FIG. 7A adds ledges 86 adhesively secured with tape 88 to the inner, bottom most ends to left and right side frame panels 14, 16. Alternately, lower inner clips 84 are adhered, or otherwise fastened, to the lower inner corners to bottom frame panel 18 in FIG. 7B.

Figure 8:
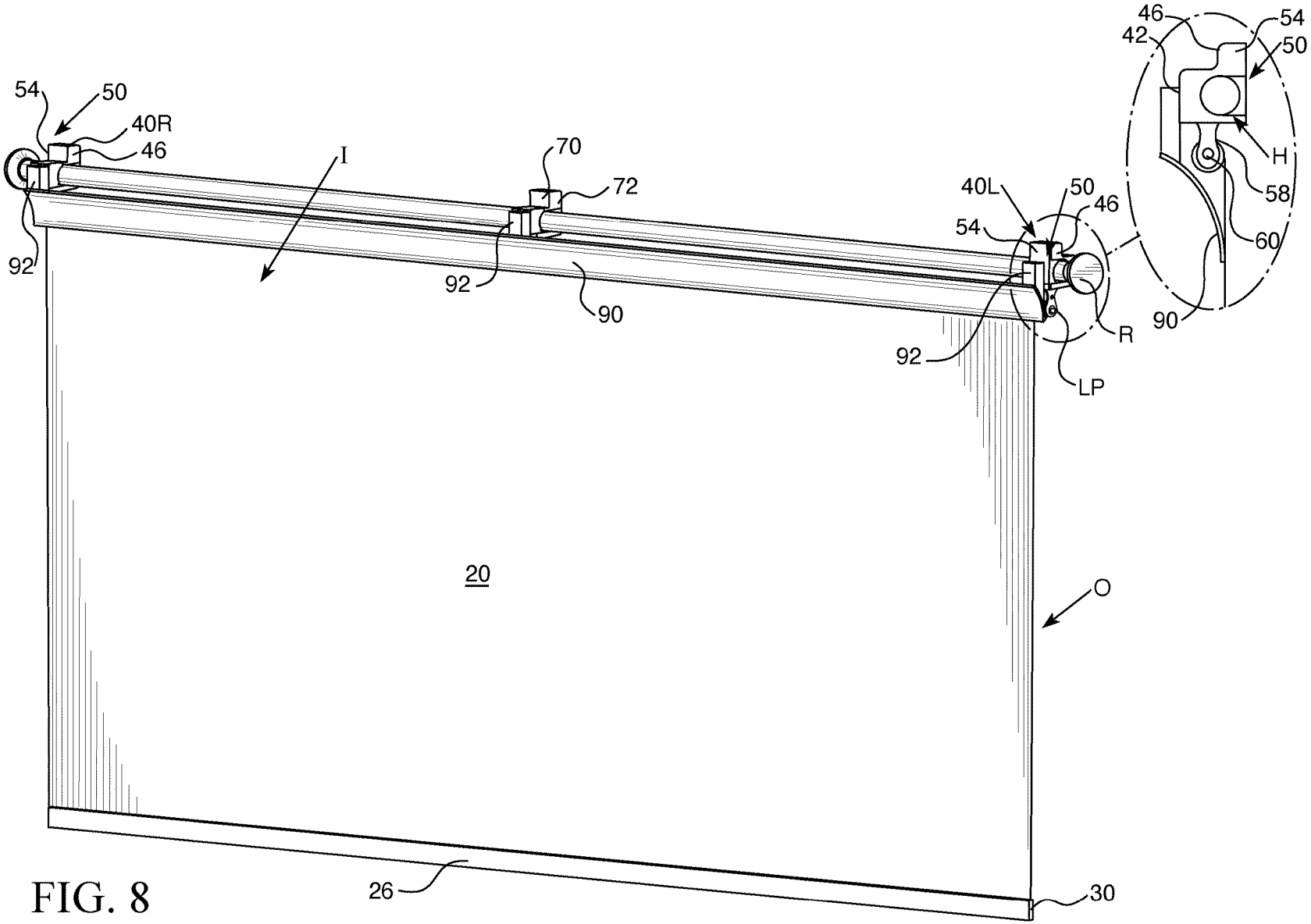
FIG. 8 is an inside front perspective view (then a close up side view) showing the optional water displacement device along the whole of the upper shower curtain assembly, said device designed to "squeegee" water off the curtain interior as it retracts back up following shower use.

Finally, in FIG. 8, there is shown one preferred optional embodiment of this invention in which a squeegee water diverter 90 has been installed across the entire interior or inside face I to retractable curtain 20. It can be held in place using physical fastener posts 92 secured by clips (or adhered) to the INTERIORS of both brackets 40L, R and any central supports, like item 70 added intermediate the two rod ends for securing an upper tub frame cover to the assembly as a whole. This "option" will help excess water from the curtain interior back into the tub for drainage and removal much like the way a washing window squeegee takes away excess water during typical window cleaning. WITH such a diverter addition, the possibility of leakage from the curtain, even outside the surrounding tub frame, has been reduced AND the addition of a squeegee-like final removal (with the retraction of used curtain back up and out-of-the-way) will reduce the chances of any leftover water residues leading to unwanted mold and/or wet smells.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. A retractable shower curtain kit for mounting on an existing shower curtain rod suspended substantially horizontally over a bathtub-shower combination, said existing shower curtain rod having a substantially horizontally extending front face and a substantially horizontally extending rear face opposite the front face, said kit, when installed, having: an upper end closest to the existing shower curtain rod, a lower end closest to a bathtub floor, a first end closest to a first sidewall of the bathtub-shower combination, a second end, opposite the first end and closest to a second sidewall of the bathtub-shower combination, a front face external to the existing shower curtain rod and a rear face opposite the front face, said curtain kit comprising:

(a) a first mounting bracket for positioning over the existing shower curtain rod at a first end of the existing shower curtain rod, said first mounting bracket including:
  (i) a first member for the first mounting bracket for wrapping about the rear face of the existing shower curtain rod at the first end of the existing shower curtain rod;
  (ii) a second member for the first mounting bracket for wrapping about the front face of the existing shower curtain rod at the first end of the existing shower curtain rod;
  (iii) means for connecting the first member for the first mounting bracket to the second member for the first mounting bracket after the first member for the first mounting bracket and the second member for the first mounting bracket are wrapped about the existing shower curtain rod at the first end of the existing shower curtain rod; and
  (iv) a first clip having an aperture into which a pin end of a retractable roller shower curtain may be positioned after the first member for the first mounting bracket and the second member for the first mounting bracket are wrapped about the existing shower curtain rod at the first end of the existing shower curtain rod, said first clip extending substantially downwardly from the existing shower curtain rod towards the bathtub floor when the kit is installed;

(b) a second mounting bracket for positioning over the existing shower curtain rod at a second end of the existing shower curtain rod, said second end being at an opposite end from the first end of the existing shower curtain rod, said second mounting bracket including:
  (i) a first member for the second mounting bracket for wrapping about the substantially horizontally extending rear face of the existing shower curtain rod at the opposite end from the first end of the existing shower curtain rod;
  (ii) a second member for the second mounting bracket for wrapping about the substantially horizontally extending front face of the existing shower curtain rod at the opposite end from the first end of the existing shower curtain rod;
  (iii) means for connecting the first member for the second mounting bracket to the second member for the second mounting bracket after the first member for the second mounting bracket and the second member for the second mounting bracket are wrapped about the existing shower curtain rod at the opposite end from the first end of the existing shower curtain rod; and
  (iv) a second clip having a slotted opening into which a rotatable spring loaded, flat end of the retractable roller shower curtain, opposite the pin end, may be positioned after the first member for the second mounting bracket and the second member for the second mounting bracket are wrapped about the existing shower curtain rod at the opposite end from the first end of the existing shower curtain rod, said second clip extending substantially downwardly from the existing shower curtain rod towards the bathtub floor when the kit is installed; and (c) the retractable roller shower curtain that includes:
  (i) a central, cylindrical roller tube;
  (ii) the pin end at the first end of the cylindrical roller tube;
  (iii) the rotatable spring loaded, flat end of the cylindrical roller tube at the end opposite the pin end; and
  (iv) a substantially rectangular section of water resistant material that is capable of extending:
    between the pin end and the rotatable spring loaded, flat end of the cylindrical roller tube, and
    from a first area directly below the existing shower curtain rod downwardly toward the bathtub floor to a second area at or near a front upper planar ledge to the bathtub of the bathtub-shower combination, said substantially rectangular section of water resistant material being wrapped about the cylindrical roller tube for repeated downward winding from and repeated upward rewinding about the cylindrical roller after installation of the retractable roller shower curtain between the first mounting bracket and the second mounting bracket.

2. The retractable shower curtain kit of claim 1 wherein the retractable roller shower curtain further includes:
  (v) a curtain bottom stiffener component that, when the kit is installed, said curtain bottom stiffener component extends substantially parallel with the existing shower curtain rod and at or near a lowermost end of the retractable roller shower curtain at least as wide as the width of the retractable roller shower curtain at the lowermost end of the retractable roller shower curtain.

3. The retractable shower curtain kit of claim 2 wherein the curtain bottom stiffener component is weighted.

4. The retractable shower curtain kit of claim 2 wherein the curtain bottom stiffener component includes on at least one end a track extension piece for locking the retractable roller shower curtain fully extended when in use.

5. The retractable shower curtain kit of claim 4 wherein the curtain bottom stiffener component includes a first track extension piece at a first end and a second track extension piece at a second end opposite the first end.

6. The retractable shower curtain kit of claim 4, which further includes one or more clips for adhesively securing to a lower wall of the bathtub to the bathtub-shower combination for temporarily locking to at least one of the track extension pieces at a first and/or a second end of the curtain bottom stiffener when the retractable roller shower curtain is fully extended for use.

7. The retractable shower curtain kit of claim 2, which further includes:
  (vi) a device for displacing water from an inside face of the shower curtain as the shower curtain retracts up after use, said water displacing device extending substantially horizontally when the kit is installed.

8. The retractable shower curtain kit of claim 7 wherein the water displacing device attaches between an interior surface of the first mounting bracket and an interior surface of the second mounting bracket.

9. The retractable shower curtain kit of claim 7, which further includes one or more intermediate brackets for positioning onto the existing shower curtain rod between the first mounting bracket and the second mounting bracket, said intermediate brackets providing additional support for the water displacing device.

10. The retractable shower curtain kit of claim 2, which further includes a tub frame surround system, said tub frame surround system comprising:

(a) an upper tub frame component for extending between an exterior surface of the first mounting bracket and an exterior surface of the second mounting bracket;

(b) a first sidewall frame component for connecting to and extending substantially downwardly from the first mounting bracket to an area at or near a front upper planar ledge to the bathtub of the bathtub-shower combination when the kit is installed;

(c) a second sidewall frame component for connecting to and extending substantially downwardly from the second mounting bracket to an area at or near the front upper planar ledge to the bathtub of the bathtub-shower combination when the kit is installed; and (d) a tub frame component for extending between the first sidewall frame component and the second sidewall frame component, said tub frame component adhering to the front upper planar ledge to the bathtub of the bathtub-shower combination.

11. The retractable shower curtain kit of claim 10 wherein a lower outer edge to the first sidewall frame component and a lower outer edge to the second sidewall frame component connect to an inside surface of the bottom tub frame component.

12. The retractable shower curtain kit of claim 10, which further includes one or more intermediate brackets for positioning onto the existing shower curtain rod between the first mounting bracket and the second mounting bracket, said intermediate brackets each having a front planar surface for adhering to the upper tub frame component of the tub frame surround system.

13. The retractable shower curtain kit of claim 10 wherein the curtain bottom stiffener component includes track extension pieces at opposed ends of the curtain bottom stiffener component and the tub frame surround system further includes one or more clips for temporarily locking to the track extension pieces at one of the opposed ends of the curtain bottom stiffener component or both of the opposed ends of the curtain bottom stiffener when the retractable roller shower curtain is fully extended for use, said locking clips being adhered to: a lower interior surface of the first sidewall frame component, a lower interior surface of the second sidewall frame component or a lower interior surface to both the first and second sidewall frame components.

14. The shower curtain kit and tub frame system of claim 1 wherein the water resistant material is selected from the group consisting of a vinyl, plastic and fabric.

* * * * *